US006099186A

United States Patent [19]

Lye

[11] Patent Number: 6,099,186

[45] Date of Patent: Aug. 8, 2000

[54] ROLLER-TYPE LIQUID APPLICATOR

[76] Inventor: Sander Lye, 4F, No. 1-3, Chung Hsiao E. Rd., Sec. 5, Taipei, Taiwan

[21] Appl. No.: 09/372,672

[22] Filed: Aug. 12, 1999

[51] Int. Cl.[7] ..... B05C 17/02

[52] U.S. Cl. ..... 401/197; 401/208

[58] Field of Search ..... 401/197, 196, 401/198, 208, 218, 219, 220, 203, 204, 205, 23; 15/103.5, 230.11, 257.06; 239/DIG. 14; 4/283, 285, 290, 291, 121

[56] References Cited

U.S. PATENT DOCUMENTS

| | | | |
|---|---|---|---|
| 2,478,318 | 8/1949 | Raub, Jr. | 401/197 |
| 4,175,300 | 11/1979 | McGlew et al. | 15/103.5 |
| 4,576,553 | 3/1986 | Winston et al. . | |
| 5,997,205 | 12/1999 | Koide | 401/147 |

*Primary Examiner*—Henry J. Recla
*Assistant Examiner*—Huyen Le

[57] ABSTRACT

A roller-type liquid applicator comprises a transporting tube member, a supporting device, a roller, a sealing device, and a gripping device. The transporting tube member is provided with a receiving hole extending along the longitudinal direction thereof, a liquid admitting hole, a liquid reverse flow hole, and a plurality of through holes. The roller comprises a fastening tube and a roller pad attached to the outer surface of the fastening tube. The fastening tube is provided with an axial hole having a diameter greater than the outer diameter of the transporting tube member, and a plurality of through holes. The supporting device is intended to enable the fastening tube to fit over the transporting tube member. The sealing device is used to seal off both open ends of the axial hole of the fastening tube. The gripping device is fastened with the transporting tube member. The liquid is absorbed by the roller pad via the liquid admitting hole, the receiving hole, the transporting tube member, and the through holes of the fastening tube. The flow of the liquid is regulated by the liquid reverse flow hole of the transporting tube member.

9 Claims, 4 Drawing Sheets

ROLLER-TYPE LIQUID APPLICATOR

FIELD OF THE INVENTION

The present invention relates generally to a roller-type device for applying a liquid, such as paint, cleansing solution, wax, etc., and more particularly to a roller-type liquid applicator which is provided with a means for transporting the liquid to the roller of the applicator, from which the liquid is applied on a workpiece.

BACKGROUND OF THE INVENTION

The conventional roller-type liquid applicator has a roller, which is dipped in a liquid such that the liquid is carried on the surface of the roller so as to facilitate the applying of the liquid on a workpiece. The conventional roller-type liquid applicator is in fact rather primitive at best in terms of the way it works. It is conceivable that the liquid carried on the surface of the roller may drip in drops on a surface other than the surface of the workpiece, and that the liquid can not be evenly applied on the surface of the workpiece. The most serious drawback of the conventional roller-type liquid applicator is that it is inefficient, especially at the time when it is used to apply the liquid on the surface of a large area.

The U.S. Pat. No. 4,576,553 discloses a technique by which the liquid is pumped into the roller of a roller-type liquid applicator. However, the internal structure of the roller is rather complicated. In addition, the pump that is used to pump the liquid into the roller must be specially designed. Moreover, the applicator must be used in conjunction with a throttle control switch so as to regulate the flow at which the roller is provided with the liquid. The throttle control device may be replaced by an expensive pump designed to feed the liquid at a constant flow rate. It is therefore readily apparent that such a prior art roller-type liquid applicator as described above is not cost-effective at best.

SUMMARY OF THE INVENTION

The primary objective of the present invention is to provide a roller-type liquid applicator which is simple in construction and is capable of a uniform application of a liquid on the surface of a workpiece in efficient and cost-effective manners.

It is another objective of the present invention to provide a roller-type liquid applicator with a means for regulating the flow of the liquid so as to enable the applicator to operate normally.

In keeping with the principle of the present invention, the foregoing objectives of the present invention are attained by a roller-type liquid applicator comprising a transporting tube member, a supporting device, a roller, a sealing device, and a gripping device. The transporting tube member is provided with a receiving chamber extending along the longitudinal direction thereof, a liquid inlet, a liquid reverse flow hole, and a plurality of through holes. The roller comprises a fastening tube and a roller pad attached to the outer surface of the fastening tube. The fastening tube is provided with an axial bore having a diameter greater than the outer diameter of the transporting tube member, and a plurality of through holes. The supporting device is intended to enable the fastening tube to fit over the transporting tube member. The sealing device is used to seal off both open ends of the axial bore of the fastening tube. The gripping device is fastened with the transporting tube member. The liquid is absorbed by the roller pad via the liquid inlet, the receiving chamber, the transporting tube member, and the through holes of the fastening tube. The flow of the liquid is regulated by the liquid reverse flow hole of the transporting tube member.

The foregoing objectives, features, functions, and advantages of the present invention will be more readily understood upon a thoughtful deliberation of the following detailed description of the embodiments of the present invention with reference to the accompanying drawings.

DETAILED DESCRIPTION OF THE INVENTION

Figure 1:
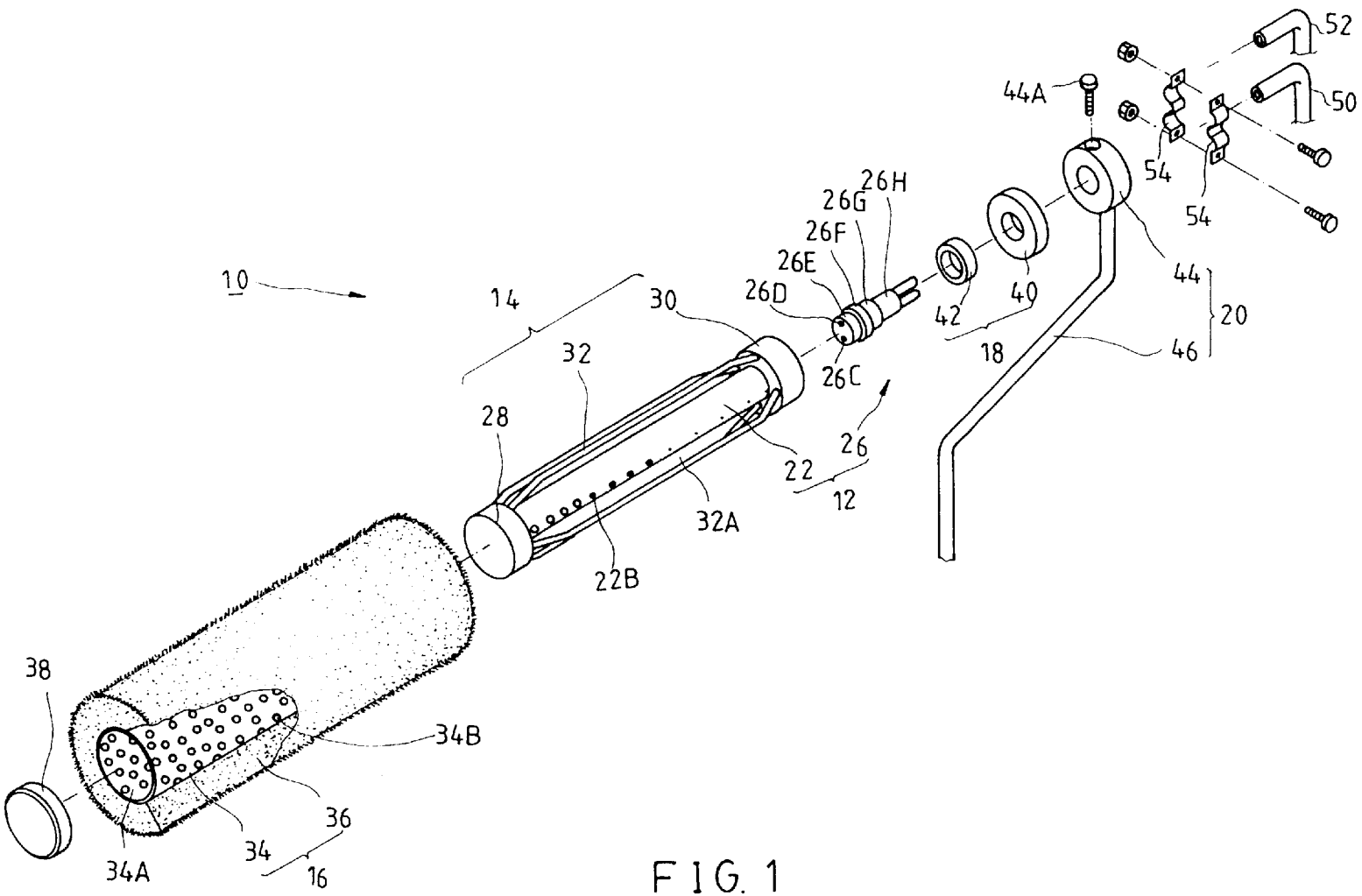
FIG. 1 shows an exploded view of a first preferred embodiment of the present invention.
Figure 2:
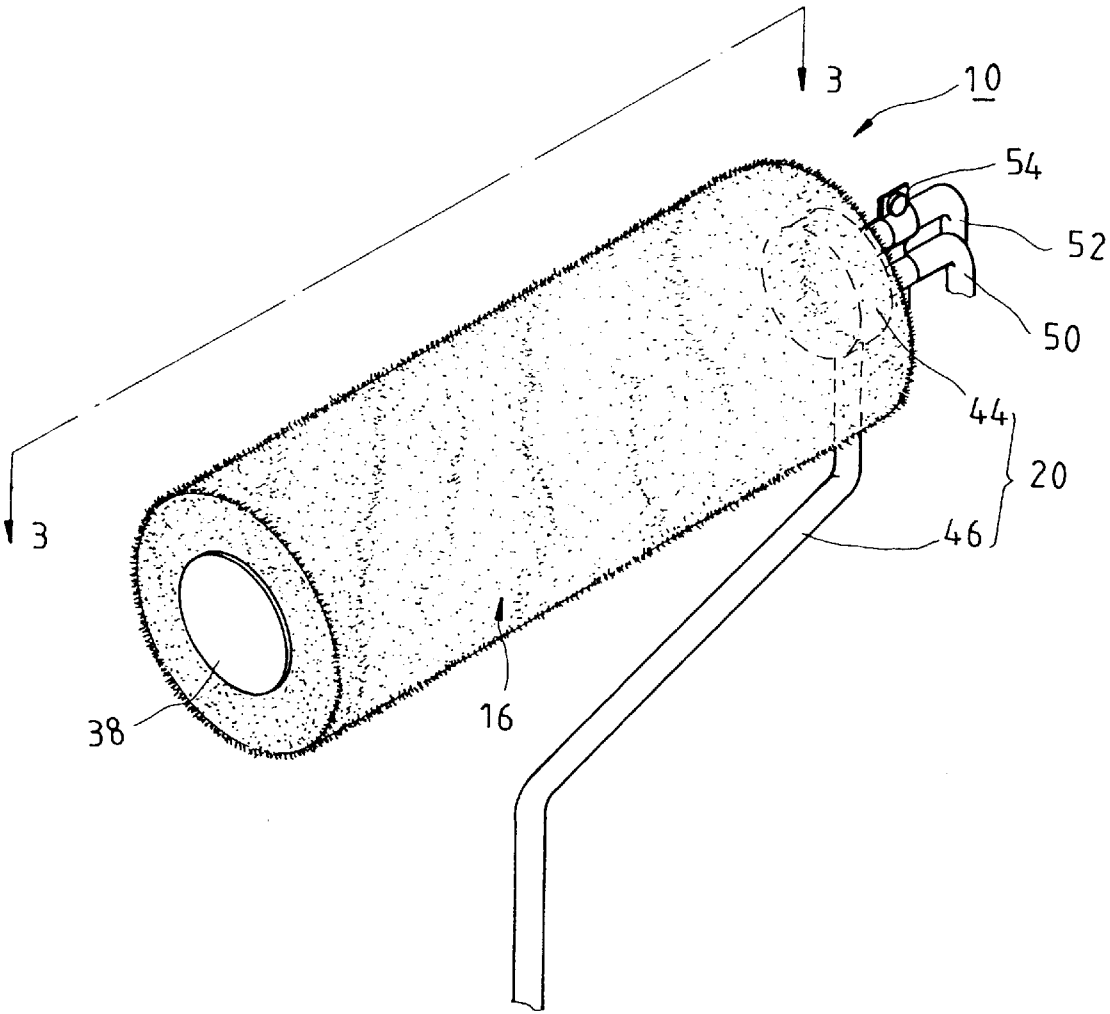
FIG. 2 shows a perspective view of the first preferred embodiment of the present invention in combination.
Figure 3:
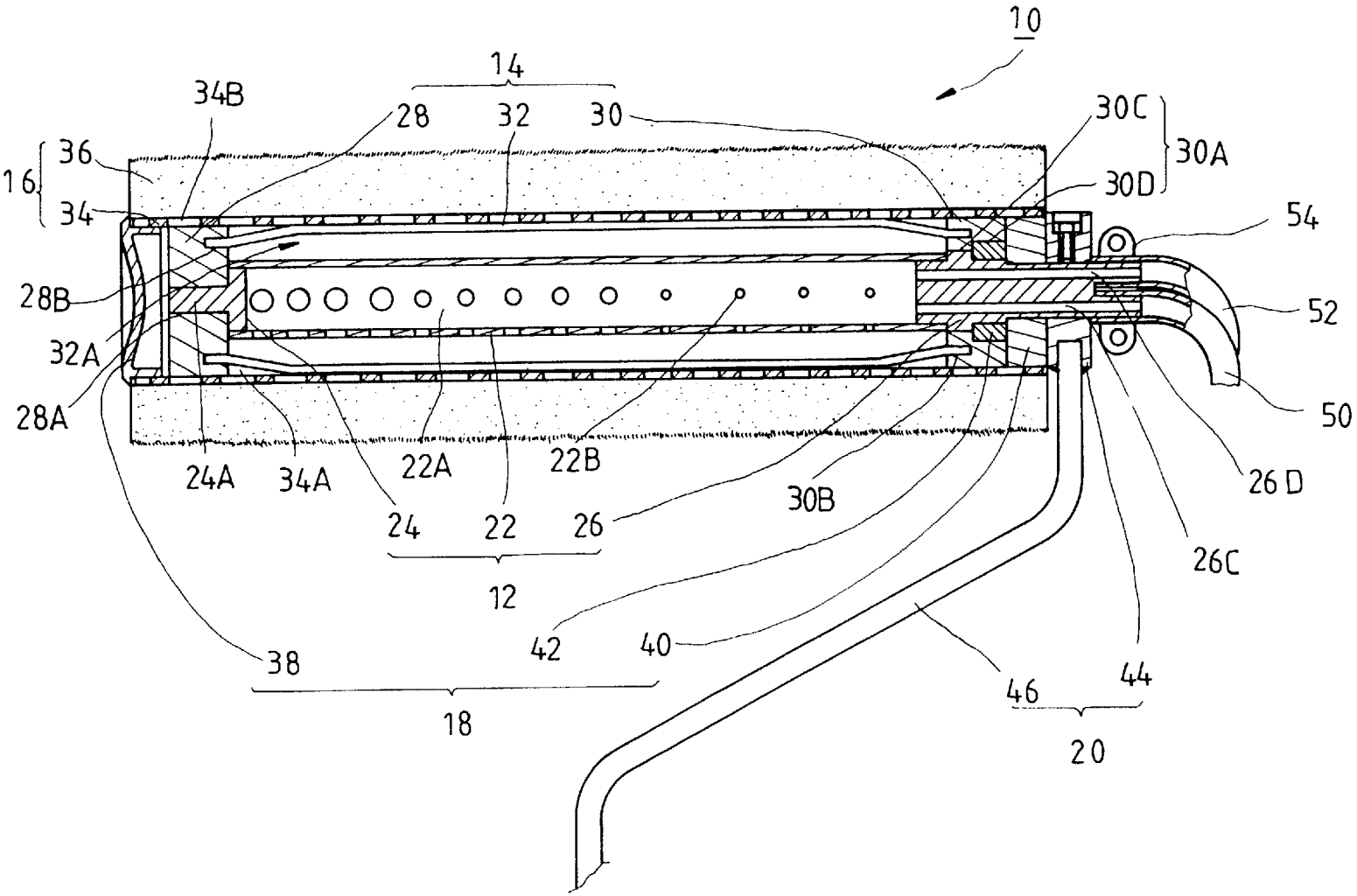
FIG. 3 shows a sectional view taken along the direction indicate d by a line 3—3 as shown in FIG. 2.

As shown in FIGS. 1–3, a roller-type liquid applicator 10 embodied in the present invention comprises a transporting tube member 12, a supporting device 14, a roller 16, a sealing device 18, and a gripping device 20.

The transporting tube member 12 comprises a tubular body 22 of a plastic material, a first shaft plug 24, and a second shaft plug 26. The tubular body 22 is provided with a receiving chamber 22A having two open ends and extending in the direction of a longitudinal axis of the tubular body 22. The tubular body 22 is provided with a plurality of through holes 22B which are arranged along the longitudinal direction thereof. The first plug 24 is inserted into one of the two open ends of the receiving chamber 22A and is provided with a rod 24A. The second plug 26 is provided with a liquid admitting hole 26C and a liquid reverse flow hole 26D, which are parallel to each other and extend from one end through other end of the second plug 26. The second plug 26 is further provided in the outer surface thereof with a first segment 26E, a second segment 26F, a third segment 26G, and a fourth segment 26H, which are arranged in that sequence and are different in outer diameter from one another. The first segment 26E is fixed in other end of the receiving chamber 22A so as to enable the liquid admitting hole 26C and the liquid reverse flow hole 26D to be in communication with the receiving chamber 22A. Now referring to FIG. 3, the through holes 22B of the tubular body 22 are arranged along the longitudinal direction of the tubular body 22 at intervals which become progressively smaller toward the one end of the receiving chamber 22A into which the first plug 24 is inserted. The through holes 22B of the tubular body 22 are different in hole diameter which is progressively larger toward the one end of the receiving chamber 22A into which the first plug 24 is inserted.

The supporting device 14 is intended to enable the roller 16 to fit over the transporting tube member 12 such that the roller 16 does not come in contact with the transporting tube member 12, and that the roller 16 is capable of turning in relation to the transporting tube member 12. The supporting device 14 comprises a first end seat 28 of a plastic material, a second end seat 30 of the plastic material, and a plurality of support rods 32 of a metal material. The first end seat 28 is provided at the center thereof with a first axial bore 28A which is provided in the periphery thereof with a plurality of first insertion holes 28B which are arranged circumferentially and are equal in number to the support rods 32. The second end seat 30 is provided in the center thereof with a second axial bore 30A extending from one end of the second end seat 30 through other end of the second end seat 30. The second axial bore 30A is provided in the periphery thereof with a plurality of second insertion holes 30B which are arranged circumferentially and are equal in number to the support rods 32. The second axial bore 30A is not uniform in the hole diameter and is formed of a small diametrical portion 30C and a large diametrical portion 30D. The support rods 32 are circumferentially arranged such that both ends of each support rods 32 are respectively inserted into the first insertion hole 28B of the first end seat 28. The support rods 32 are provided with a receiving space 32A for accommodating the transporting tube member 12. In the meantime, the second plug 26 is received in the second axial bore 30A. In light of the hole diameter of the small diametrical portion 30C being slightly greater than the outer diameter of the second segment 26F of the second plug 26, the supporting device 14 is capable of turning on the first plug 24 and the second plug 26 such that the supporting device 14 revolves around the transporting tube member 12.

The roller 16 is formed of a fastening tube 34 and a roller pad 36 which is attached to the outer surface of the fastening tube 34. The fastening tube 34 is made of a plastic material and provided with an axial bore 34A having two open ends. The axial bore 34A has a hole diameter which is far greater than the outer diameter of the transporting tube member 12. The fastening tube 34 is provided with a plurality of through holes 34B enabling the axial bore 34A to be in communication with the outer periphery of the fastening tube 34. The roller pad 36 is made of sponge, cotton, synthetic fibers, or wool, and is highly capable of absorbing the liquid to be applied on a workpiece. The roller 16 is fitted over the supporting device 14 such that the roller 16 is kept apart from the transporting tube member 12 by a predetermined distance in view of the wall of the axial bore 34A of the fastening tube 34 being pressed against by the metal support rods 32. The roller 16 rotates along with the supporting device 14.

The sealing device 18 comprises a first end cover 38, a second end cover 40, and a sealing ring 42. The first end cover 38 is inserted into one open end of the axial bore 34A of the fastening tube 34. The sealing ring 42 is fitted over the third segment 26G of the second plug 26 such that the large diametrical portion 30D of the second axial bore 30A is sealed off by the sealing ring 42. The second end cover 40 is provided in the center thereof with a through hole 40A and is fitted over the fourth segment 26H of the second plug 26. The second end cover 40 is inserted into other open end of the axial bore 34A of the fastening tube 34.

The gripping device 20 comprises a fastening ring 44 and a fastening rod 46. The fastening ring 44 is fitted over the fourth segment 26H of the second plug 26 such that the fastening ring 44 is fixed by a fastening screw 44A. The fastening rod 46 is made of a metal material and is fastened at one end thereof with the fastening ring 44 by welding. The fastening rod 46 is fastened at other end thereof with a hand grip (not shown in the drawing).

In operation, the liquid admitting hole 26C and the liquid reverse flow hole 26D are respectively connected with one end of a first hose 50 and one end of a second hose 52. The connections are reinforced by a fastening piece 54. The first hose 50 is connected at other end thereof with a liquid transporting device (not shown in the drawing), such as a manual or power pump. The second hose 52 is connected at other end thereof with a liquid reservoir of the liquid transporting device. The liquid contained in the reservoir is fed into the transporting tube member 12 and is then absorbed by the roller pad 36 via the through holes 22B of the transporting tube member 12 and the through holes 34B of the fastening tube 34. The liquid absorbed by the roller pad 36 is applied on a workpiece. In the event that the flow rate of the liquid reaching the roller pad 36 is faster than the rate of the liquid being applied on the workpiece, the excess of the liquid is temporarily kept in the transporting tube member 12 and the roller 16 until such time when the level of the "excess liquid" is higher than the liquid reverse flow hole 26D, thereby resulting in the draining of the "excess liquid" via the liquid reverse flow hole 26D. The drained "excess liquid" is sent back to the liquid reservoir. As a result, the roller 16 is always provided with a constant quantity of the liquid so as to ensure that the workpiece is uniformly coated with the liquid. In addition, the through holes 22B of the tubular body 22 of the transporting tube member 12 are designed in such a manner that they are arranged at different intervals along the longitudinal direction of the tubular body 22, and that they differ from one another in hole diameter, the liquid is thus able to flow evenly along the longitudinal direction of the tubular body 22.

Figure 4:
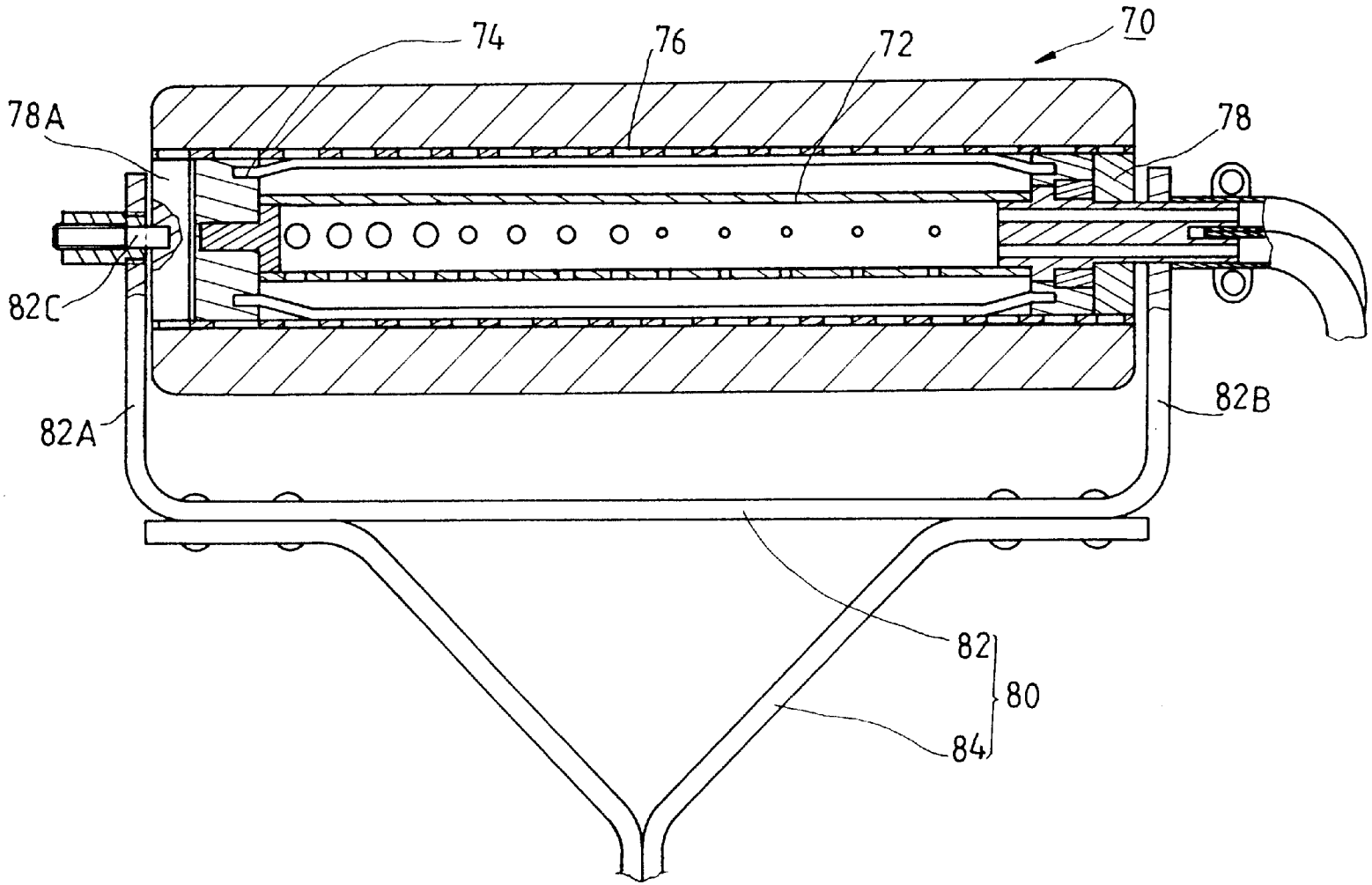
FIG. 4 shows a longitudinal sectional view of a second preferred embodiment of the present invention.

As shown in FIG. 4, a roller-type liquid applicator 70 of the second preferred embodiment of the present invention comprises a transporting tube member 72, a supporting device 74, a roller 76, a sealing device 78, and a gripping device 80.

The roller-type liquid applicator 70 of the second preferred embodiment is different from the roller-type liquid applicator 10 of the first preferred embodiment in that the gripping device 80 of the former comprises a fastening rod 82 and a grip rod 84. The fastening rod 82 is provided with a first side plate 82A and a second side plate 82B which is kept apart from the first side plate 82A by a predetermined distance. The first side plate 82A is fastened pivotally with the first end cover 78A of the sealing device 78 by a pivot 82C. The second side plate 82B is fastened with the transporting tube member 72. The grip rod 84 is formed of two curved rod members. The grip rod 84 is fastened at one end thereof with the fastening rod 82 by riveting, and is provided at other end thereof with a hand grip (not shown in the drawing). As a result, the transporting tube member 72, the supporting device 74, and both ends of the roller 76 are evenly supported on the gripping device 80, thereby enhancing the sealing effect of the applicator 70 and prolonging the service life span of the applicator 70.

What is claimed is:

1. A roller-type liquid applicator comprising:

a transporting tube member having opposite ends provided with a receiving chamber extending along the direction of a longitudinal axis thereof, said receiving chamber provided at one end thereof with a liquid admitting hole in communication with said receiving chamber, and a liquid reverse flow hole in communication with said receiving chamber, said transporting tube member further provided with a plurality of through holes which are arranged along the longitudinal direction of said transporting tube member and are in communication with said receiving chamber;

a roller comprising a fastening tube and a roller pad fastened with an outer surface of said fastening tube, said fastening tube being provided with an axial bore having two open ends and a bore diameter greater than an outer diameter of said transporting tube member whereby said fastening tube is further provided with a plurality of through holes which are arranged circumferentially;

a supporting device enabling said fastening tube of said roller to be fitted over and rotatably connected to said opposite ends of said transporting tube member such that said fastening tube is kept apart from said transporting tube member by a distance, and that said fastening tube rotates relative to said transporting tube member;

a sealing device for sealing off said two open ends of said axial bore of said fastening tube of said roller; and a gripping device connected with said transporting tube member for gripping by a hand;

whereby a liquid can be applied on a workpiece being fed into said receiving chamber via said liquid admitting hole such that the liquid is absorbed by said roller pad via said through holes of said transporting tube member and said through holes of said fastening tube of said roller, and that an excess of the liquid can be drained via said liquid reverse flow hole of said transporting tube member.

2. The roller-type liquid applicator as defined in claim 1 wherein said through holes of said transporting tube member are arranged along the longitudinal direction of said transporting tube member at intervals which become progressively smaller from said one end of said receiving chamber toward other end of said receiving chamber.

3. The roller-type liquid applicator as defined in claim 1, wherein said through holes of said transporting tube member are different in hole diameter which is progressively larger from said one end of said receiving chamber toward other end of said receiving chamber.

4. The roller-type liquid applicator as defined in claim 1, wherein said transporting tube member comprises a tubular body, a first plug, and a second plug whereby said tubular body is provided with said receiving chamber having said two open ends into which said first plug and said second plug are inserted whereby said second plug is provided with said liquid admitting hole and said liquid reverse flow hole.

5. The roller-type liquid applicator as defined in claim 4, wherein said supporting device comprises a first end seat, a second end seat, and a plurality of support rods which are circularly arranged such that both ends of said support rods are fastened respectively with said first end seat and said second end seat so as to confine a receiving space to accommodate said transporting tube member, said first end seat being provided with a first axial bore into which said first plug is inserted, said second end seat being provided with a second axial bore into which said second plug is inserted; and wherein said roller is fitted over said supporting device such that the wall of said axial bore of said fastening tube of said roller is pressed against by said support rods, thereby enabling said roller to be kept apart from said transporting tube member by a distance whereby said roller rotates relative to said transporting tube member.

6. The roller-type liquid applicator as defined in claim 5, wherein said sealing device comprises a first end cover, and a second end cover, which are respectively inserted into said two open ends of said axial bore of said fastening tube.

7. The roller-type liquid applicator as defined in claim 6, wherein said sealing device further comprises a sealing ring which is fitted over said second plug and is located between said second end seat and said second end cover.

8. The roller-type liquid applicator as defined in claim 6, wherein said gripping device comprises a first side plate, a second side plate, and a grip rod connected with said first side plate and said second side plate whereby said first side plate is fastened pivotally with said first end cover by a pivot, said second side plate being fastened with said second plug, said grip rod being provided with a hand grip.

9. The roller-type liquid applicator as defined in claim 1, wherein said gripping device comprises a fastening ring fitted over said transporting tube member, and a fastening rod which is fastened at one end thereof with said fastening ring, and is provided at other end thereof with a hand grip fitted thereover.

* * * * *